US005293356A

United States Patent [19]

Chin-Hsing

[11] Patent Number: 5,293,356

[45] Date of Patent: * Mar. 8, 1994

[54] VOCAL REPORTING DEVICE FOR POINTER TYPE TIMERS WITH PHOTOELECTRIC CALIBRATION DEVICE

[75] Inventor: Feng Chin-Hsing, Hsien, Taiwan

[73] Assignees: Tai-Chia Feng; Jung-Fu Pan, both of Taiwan

[ * ] Notice: The portion of the term of this patent subsequent to Oct. 10, 2006 has been disclaimed.

[21] Appl. No.: 834,377

[22] Filed: Feb. 12, 1992

[51] Int. Cl.[5] ..... G04B 21/00

[52] U.S. Cl. ..... 368/63; 368/75; 368/272

[58] Field of Search ..... 368/272-274, 368/72-75, 243-271, 63

[56] References Cited

U.S. PATENT DOCUMENTS

| | | | |
|---|---|---|---|
| 1,889,108 | 11/1932 | Rattig | 368/63 |
| 3,135,084 | 6/1964 | Kidder | 368/63 |
| 4,369,297 | 8/1983 | Akahne | 368/272 |
| 4,531,841 | 1/1985 | Thompson et al. | 368/63 |
| 4,712,926 | 12/1987 | Tanabe . | |

*Primary Examiner*—Bernard Roskoski
*Attorney, Agent, or Firm*—Bacon & Thomas

[57] ABSTRACT

A vocal reporting device for pointer type timers comprising a printed circuit board which converts the positions of the pointers into electric signals and sends the same to a microprocessor to broadcast the time associated therewith with a voice synthesizing circuit and a speaker. A photoelectric calibration device detects the positions of the pointers and then calibrate the microprocessor with the detected pointer positions.

4 Claims, 4 Drawing Sheets

| | 12–1 | 1–2 | 2–3 | 3–4 | 4–5 | 5–6 | 6–7 | 7–8 | 8–9 | 9–10 | 10–11 | 11–12 |
|---|---|---|---|---|---|---|---|---|---|---|---|---|
| S1 | 1 | 1 | 1 | 0 | 0 | 0 | 0 | 0 | 0 | 0 | 0 | 0 |
| S2 | 0 | 0 | 1 | 1 | 1 | 0 | 0 | 0 | 0 | 0 | 0 | 0 |
| S3 | 0 | 0 | 0 | 0 | 1 | 1 | 1 | 0 | 0 | 0 | 0 | 0 |
| S4 | 0 | 0 | 0 | 0 | 0 | 0 | 1 | 1 | 1 | 0 | 0 | 0 |
| S5 | 0 | 0 | 0 | 0 | 0 | 0 | 0 | 0 | 1 | 1 | 1 | 0 |
| S6 | 1 | 0 | 0 | 0 | 0 | 0 | 0 | 0 | 0 | 0 | 1 | 1 |

FIG. 2B

VOCAL REPORTING DEVICE FOR POINTER TYPE TIMERS WITH PHOTOELECTRIC CALIBRATION DEVICE

FIELD OF THE INVENTION

The invention relates generally to a time reporting system and in particular to a vocal reporting device for pointer type timers with a photoelectric calibration device.

BACKGROUND OF THE INVENTION

Digital timers or electronic timers with a vocal system to report time in a synthetic voice is a recently-developed product. It can be readily done by making use of the digital signal generated by the timer. To incorporate a conventional timer or a pointer type timer with a vocal reporting system, however, is much more difficult, for the pointers of a timer provide analog signals (positions of the pointers), while the current commercially available voice synthesizing devices are digital devices. A converter is inevitably a must for conversions between those signals.

OBJECTS OF THE INVENTION

It is therefore an object of the present invention to provide a converting device which is incorporated in a pointer type timer to convert, with electromagnetic means, photoelectric means, capacitance means etc. a mechanical time signal (i.e. positions of the pointers) into a digital time signal which is in turn used in a voice synthesis device to produce the desired vocal report of time upon triggered or to vocal reporting time at every predetermined interval.

It is another object of the present invention to provide a photoelectric counting device to be incorporated in a pointer type timer which has a microprocessor to control the driving means of the timer, the photoelectric counting device providing counts associated with a time interval to the microprocessor for mutual calibration.

To achieve the above-mentioned objects, there is provided a vocal reporting device for pointer type timers comprising a printed circuit board which converts the positions of the pointers into electric signals and sends the same to a microprocessor to broadcast the time associated therewith with a voice synthesizing circuit and a speaker. A photoelectric calibration device detects the positions of the pointers and then calibrate the microprocessor with the detected pointer positions.

other objects and advantages of the invention will be apparent from the following description of the preferred embodiments taken in connection with the accompanying drawings wherein:

BRIEF DESCRIPTION OF THE DRAWINGS

FIGS. 2A and 2B are respectively a top view of an encoding disk incorporated in the device shown in FIG. 1 and the transformation table associated therewith.

DETAILED DESCRIPTION OF THE PREFERRED EMBODIMENTS

Figure 1:
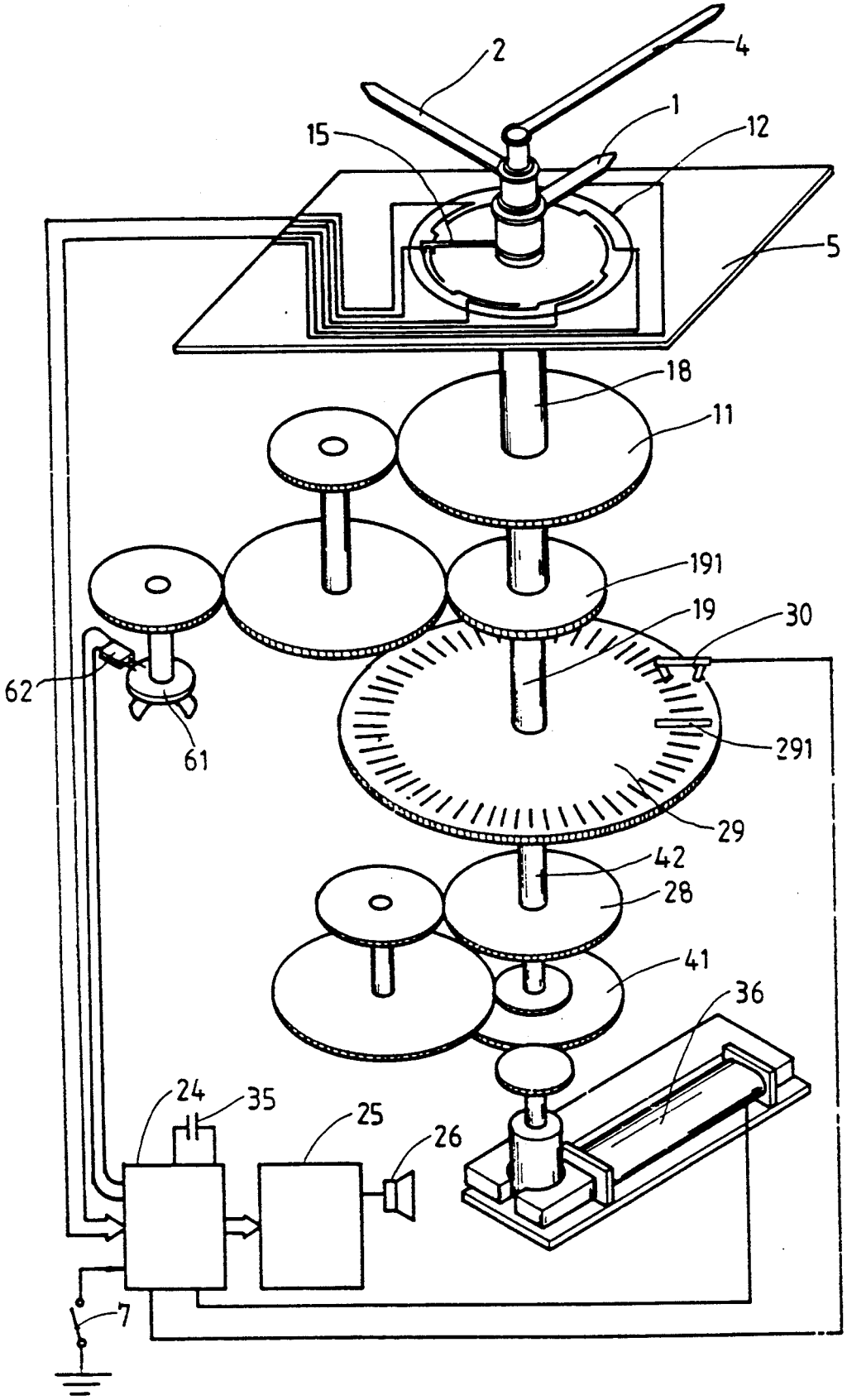
FIG. 1 is a perspective view of a vocal reporting device of the present invention showing the mechanical portion thereof and schematically showing the electronic portion thereof.

With reference to the drawings and in particular to FIG. 1, a pointer type timer comprises an hour pointer 1, a minute pointer 2 and a second pointer 4 which are respectively driven by an hour gear 11, a minute gear 28 and a second gear 41 through an hour shaft 18, a minute shaft 19 and a second shaft 42. The hour shaft 18, minute shaft 19 and second shaft 42 are preferably coaxially arranged. The second gear 41 is driven by a stepping motor 36 and the minute gear 28 and the hour gear 11 are mechanically connected to the second gear 41 with gear trains of specific gear ratios. This is well known to those skilled in the art and no detail will be necessary herein.

Figure 2A:
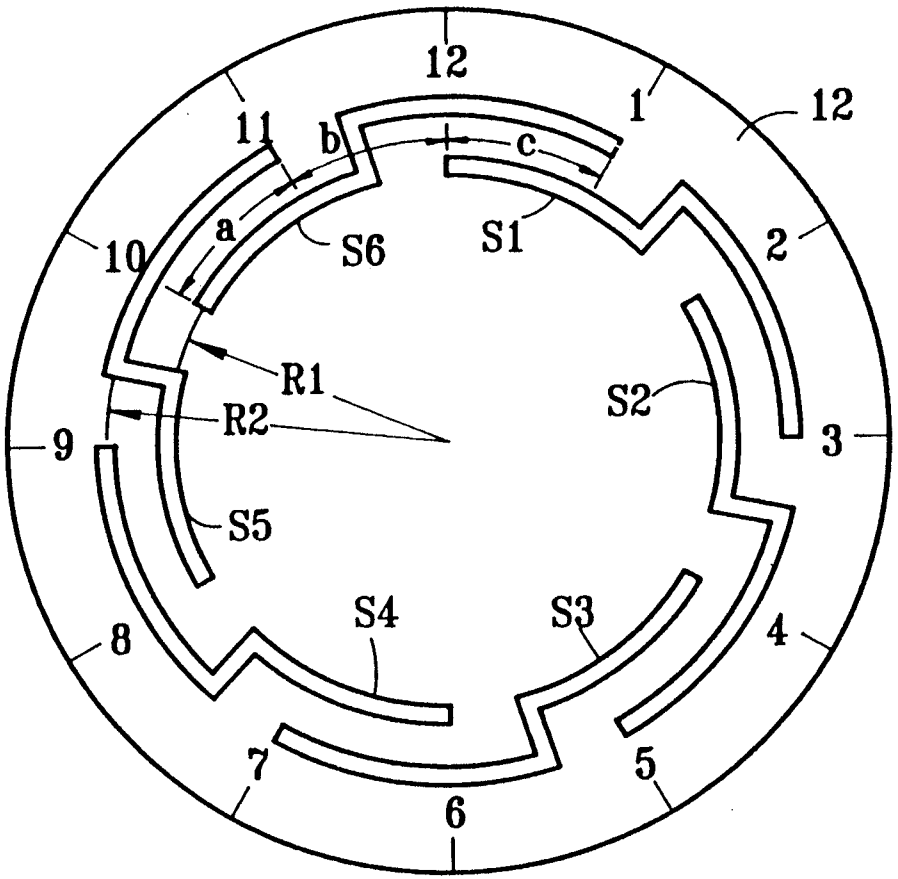

In accordance with an aspect of the present invention, a printed circuit board 5 on which a circular encoding circuit 12 is printed is provided so that the pointers 1, 2 and 4 and thus the rotating shafts 18, 19 and 42 associated therewith are rotatable with respect thereto. The details of the circuit 12 is shown in FIG. 2A and the transformation table associated therewith is shown in FIG. 2B. An encoding arm 15 which is secured on the hour shaft 18 to be synchronously rotatable therewith is in electrical contact with the printed circuit 12 to detect the angular position of the hour shaft 18. An electric signal which is related to the position of the pointers and thus the time associated therewith is thus generated. The time signal so generated is sent to a central processing unit 24 via electrical wires. The central processing unit 24 manipulates the time signal and decodes the time associated therewith in order to speak out the time via a speaker 26 controlled by a voice synthesizing device 25 when a switch 7 is closed or triggered.

A clock signal generator, for example an oscillating quartz 35 in the embodiment, supplies a series of pulses to the central process unit 24, serving as the clock of the microprocessor 24, to generate a digital time signal in the central processing unit 24 by means of the frequency division technique. Besides, the series pulses are also serving as the control basis of the stepping motor 36 which provides rotations to the pointers of the timer. With the arrangement, the central processing unit 24 and the stepping motor 36 are synchronous.

A photoelectric counting disk 29, which has a plurality of angularly equally-spaced reflective strips formed thereon, is secured on the minute shaft 19 to be rotatable therewith. Preferably, the number of the reflective strips is sixty, one indicating a minute. Obviously, other quantities of the reflective strips, such as thirty, can also be adapted. One of the reflective strips is enlarged as designated by the numeral 291 in FIGS. 1 and 3 to be used as an indication of the beginning of all the strips. A photoelectric element 30, preferably comprising a light emitting device and a photo-detector, is disposed in such a position that light emitted from the light emitting device can be reflected by the reflective strips and then received by the photo-detector. A signal can then be sent to the central processing unit 24 when the photo-detector senses a reflected light beam. The signal is used as a calibration signal between the central processing unit 24 and the pointers 1, 2 and 4.

To manually adjust the timer, a manual button 61 is depressed and rotated to rotate the minute shaft 19 via a gear train constituted partly by the minute gear 191. At the same time, a micro-switch 62 is triggered to have the central processing unit 24 ready for time calibration and actuate the photo element 30 to monitor the counting disk 29. When manually adjusting the positions of the timer pointers 1, 2 and 4, the counting disk 29 should be reset first, namely the enlarged strip 291 in alignment with the photoelectric element 30. When the pointers 1, 2 and 4 and the counting disk 29 are manually rotated clockwise, the count recorded in the central processing unit 24 increases and when the pointers, together with the counting disk 29, is manually rotated counterclockwise, the count in the central processing unit 24 decreases. The central processing unit 24 will then adjust the digital time signal thereof according to the change of the count.

Due to the fact that the photoelectric element 30 keeps tracking the rotation of the counting disk 29 and informing the central processing unit 24 of the same, the digital time signal of the central processing unit 24 is maintained synchronous with the positions of the pointers 1, 2 and 4. Further, with the arrangement, the enlarged strip 291 provides the central processing unit 24 with a calibration signal every hour, for the counting disk 29 is secured on the minute shaft 19 and rotating therewith.

According to an aspect of the present invention, the encoding circuit 12 printed on the circuit board 5 comprises a plurality of conductive encoding index strips S1, S2, . . . , Sn (wherein n is six in the embodiment shown in FIG. 2A) disposed on a circle of a plurality of equal divisions formed on the circular encoding circuit JL2, wherein the number thereof is twice of the index strips, namely 2n in this case. Each of index strips comprises a first section a, a second section b, and a third section c, wherein the first section a and part of the second section b are along a first arc of radius R1 while the third section c and the remaining part of second section b are along a second arc of a larger radius R2 which is concentric with the first arc. The part of second section b in the first arc and the remaining part of second section b which is in the second arc are connected together with a segment extending substantially in an axial direction. Both the first section a of each of the encoding index strips and the third section c of the previous encoding index strip are in the same one of the divisions of the circular circuit 12 and are opposite and spaced from each other.

The transformation table resulted from such an arrangement is shown in FIG. 2B. As can be read from the transformation table shown in FIG. 2B, when the index strips S1 and S6 are in a logic HIGH status, namely an electric signal, which may be a voltage signal or a current signal, is present in the index strips S1 and S6, a time between twelve o'clock and one o'clock is indicated. The other situations can be interpreted in the same way.

It is conventional to provide a housing (not shown) to have the above-described members or elements disposed therein and a dial face to indicate the time when the pointers are in corresponding positions.

To reduce the energy consumption of the photoelectric element 30, the emission of light from the photoelectric element 30 may be under the control of the central processing unit 24 and is conducted only at a short period, for example twenty seconds, before the counting disk 29 completes a turn.

Figure 3:
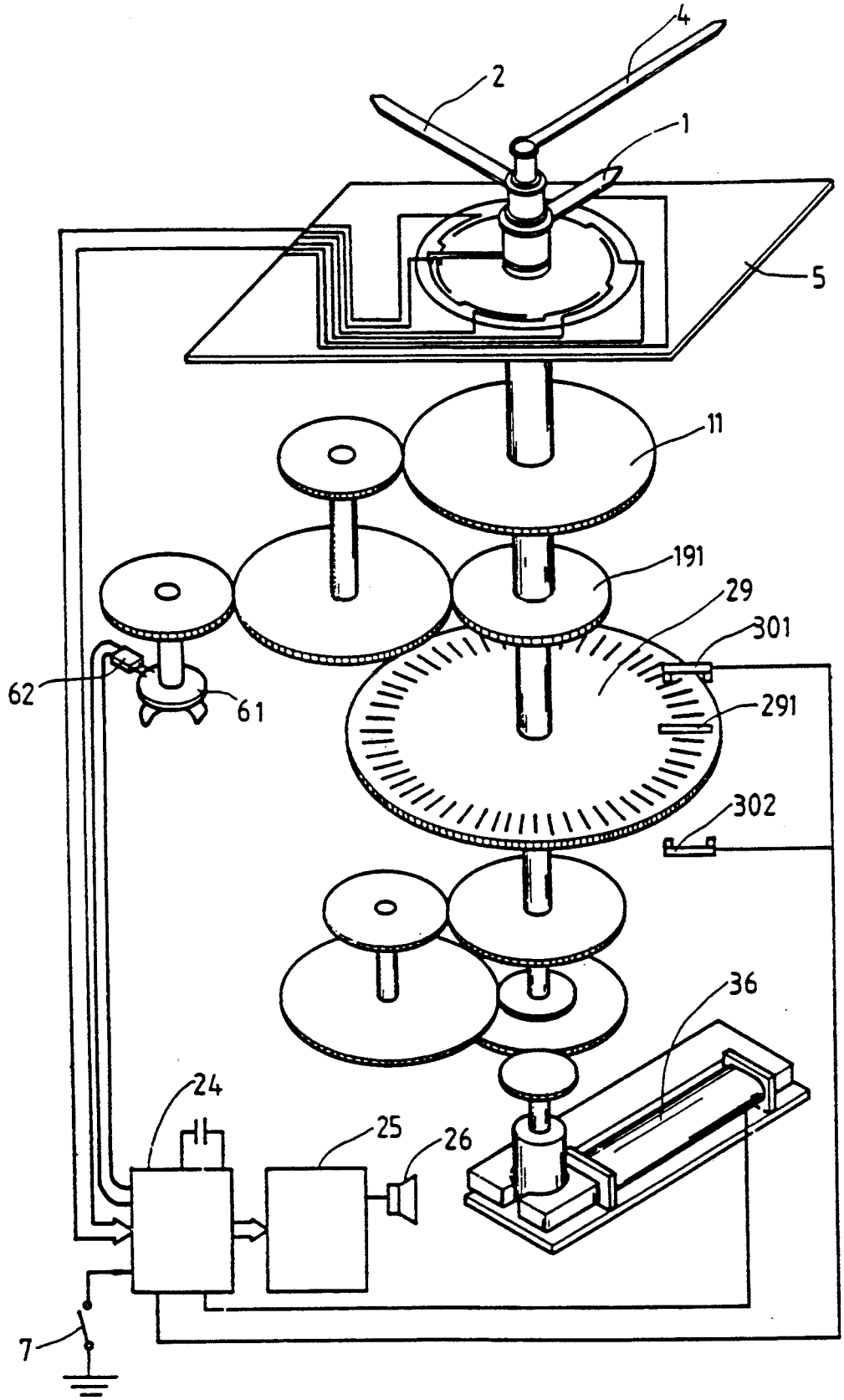
FIG. 3 is a perspective view similar to FIG. 1 showing another embodiment of the present invention.

In FIG. 3, a second embodiment of the present invention is shown. The second embodiment is essentially the same as the first embodiment described previously with only the photo-detector and the light emitting device contained in the photoelectric element 30 spaced apart in this embodiment and disposed on the opposite sides of the counting disk 29 on which a plurality of angularly equally-spaced through slits are formed, instead of the attaching thereon the reflective strips, to allow light beams to pass therethrough.

It is apparent that although the invention has been described in connection with the preferred embodiments, it is contemplated that those skilled in the art may make changes to certain features of the preferred embodiments without altering the overall basic function and concept of the invention and without departing from the spirit and scope of the invention as defined in the appended claims.

What is claimed is:

1. A vocal reporting device for pointer type timers with a photoelectric calibration device, wherein said pointer type timers comprise an hour pointer, a minute pointer and a second pointer respectively secured on and thus rotated by an hour shaft, a minute shaft and a second shaft which are in turn respectively driven by an hour gear, a minute gear and a second gear which are mechanically interconnected, said second gear being driven by a driving means and the improvements comprising a microprocessor, a voice synthesizing means which receives a digital time signal from the microprocessor and broadcasts said time signal upon triggered, an encoding board with an encoding circuit printed thereon and said photoelectric calibration device, said encoding circuit having a plurality of conductive index strips disposed thereon, an encoding arm, which is secured on the hour shaft and synchronously rotatable therewith with respect to the encoding circuit, cooperating with the index strips to provide the microprocessor with a calibration signal at every predetermined interval to synchronize the microprocessor with the pointers, said photoelectric calibration device comprising a counting disk secured on the minute shaft to be rotatable therewith and a photoelectric element containing at least a light emitting device to emit a light beam to interact with said counting disk and a photodetector to send, in response to said light beam interacted with said counting disk, a signal to said microprocessor for calibration.

2. A vocal reporting device for pointer type timers with a photoelectric calibration device as claimed in claim 1, wherein said driving means is a stepping motor.

3. A vocal reporting device for pointer type timers with a photoelectric calibration device as claimed in claim 1, wherein said counting disk has a plurality of equally-spaced light reflective strips angularly disposed thereon to reflect the light beam emitted from the light emitting device to the photo-detector.

4. A vocal reporting device for pointer type timers with a photoelectric calibration device as claimed in claim 1, wherein said counting disk has a plurality of angularly equally-spaced through slits formed thereon to allow the light beam emitted from the light emitting device to pass through and thus reaching the photodetector.

* * * * *